US011678777B2

(12) United States Patent
Yoo et al.

(10) Patent No.: US 11,678,777 B2
(45) Date of Patent: Jun. 20, 2023

(54) DRYER

(71) Applicant: LG ELECTRONICS INC., Seoul (KR)

(72) Inventors: Hyunsun Yoo, Seoul (KR); Jaehung Chun, Seoul (KR); Yousook Eun, Seoul (KR); Joogyeom Kim, Seoul (KR); Sungkyung Kim, Seoul (KR); Myongsun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 944 days.

(21) Appl. No.: 16/576,331

(22) Filed: Sep. 19, 2019

(65) Prior Publication Data

US 2020/0085253 A1 Mar. 19, 2020

Related U.S. Application Data

(60) Provisional application No. 62/733,478, filed on Sep. 19, 2018.

(30) Foreign Application Priority Data

Jan. 18, 2019 (KR) ..... 10-2019-0006768

(51) Int. Cl.
*A47K 10/48* (2006.01)

(52) U.S. Cl.
CPC ..... *A47K 10/48* (2013.01)

(58) Field of Classification Search
CPC ..... A47K 10/48; A45D 20/00; A45D 20/10; A45D 20/12; A45D 20/122; A45D 20/124
See application file for complete search history.

(56) References Cited

U.S. PATENT DOCUMENTS

2005/0072019 A1* 4/2005 Rago ..... A45D 20/12 34/96
2006/0254073 A1 11/2006 Zhen

FOREIGN PATENT DOCUMENTS

| | | | | |
|---|---|---|---|---|
| DE | 9305195.6 | U1 | 6/1993 | |
| JP | 2004-176597 | A | 6/2004 | |
| JP | 2010131259 | A * | 6/2010 | |
| KR | 10-1345488 | B1 | 12/2013 | |
| KR | 10-1490979 | B1 | 2/2015 | |
| WO | WO-02080728 | A1 * | 10/2002 | ..... A45D 20/12 |

* cited by examiner

*Primary Examiner* — Edelmira Bosques
*Assistant Examiner* — Bao D Nguyen
(74) *Attorney, Agent, or Firm* — Birch, Stewart, Kolasch & Birch, LLP

(57) ABSTRACT

A dryer includes a hollow casing having an open front, a fan configured to introduce air into the casing and blow the air, a heater configured to heat the air introduced into the casing, a discharge tube disposed at a downstream side of the fan to be thereby rotatable inside the casing, and having an air inlet formed at a rear and an air outlet formed at a front, a motor configured to generate power for driving the discharge tube, and having a rotation shaft, and a connector connected to the rotation shaft so as to enable the discharge tube to be rotated about a first axial line of the rotation shaft, and connected to the discharge tube so as to enable the discharge tube to be rotated about a second axial line forming a predetermined angle relative to the first axial line.

17 Claims, 16 Drawing Sheets

DRYER

CROSS REFERENCE TO RELATED APPLICATIONS

This application claims the priority benefit of U.S. Provisional Application No. 62/733,478, filed on Sep. 19, 2018, and Korean Patent Application No. 10-2019-0006768, filed on Jan. 18, 2019, the entire disclosures of all of which are hereby expressly incorporated by reference into the present application.

BACKGROUND OF THE DISCLOSURE

Field of the disclosure

The present disclosure relates to a dryer for drying a particular object by discharging heated air. More particularly, the present disclosure relates to a dryer including a hollow casing, a blowing fan, a motor, and a heater configured to dry a particular object by discharging heated drying air.

Description of the Related Art

A dryer for drying a human body should be designed to prevent the human body from being burned or hurt by drying air, and a temperature of the drying air should be maintained at a level at which a user can feel comfortable. In addition, the dryer should be designed such that a drying operation can be completed as quickly as possible, noise caused by an air flow can be reduced, and the user is allowed to use the dryer easily and conveniently.

Thus, the dryer should be designed by taking into consideration body characteristics of a drying target, as well as a size and shape of the entire dryer, a heating temperature of drying air, an amount of air to be discharged, a discharge rate, and a size of an air outlet.

If a drying target is an infant or a pet, the target may be under stress during a drying operation, but incapable of communicating about it. Thus, in order to perform a drying operation most suitable for body characteristics of each target, it is desirable to design a dryer capable of automatically adjusting a temperature and a discharge rate, and drawing attention and interest from an infant or pet during the drying operation so that the infant or pet can enjoy the drying operation.

In particular, it is necessary to prevent heated drying air from being discharged while focused on one spot, since infants have very sensitive and thin skin.

KR 10-1490979B discloses a multifunctional hair dryer, in which a rotational blade capable of converting a flow of heated air into a vortex is installed at an air outlet of the dryer, thereby extending an area to dry. However, this related art increases noise caused by operation of the rotational blade, focuses discharged air at one spot, thereby failing to quickly dry a particular body part, and excessively disperses drying air, thereby reducing drying performance.

US2006/0254073A discloses a dual-fan hair dryer which has a plurality of fan blades to thereby improve performance in introducing and discharging air, and which is capable of reducing noise and adjusting an amount of drying air to be discharged. However, this related art fails to disclose a means capable of discharging drying air in a dispersing manner or changing a direction of the discharge air.

In order to extend an area to discharge drying air from a dryer, it is desirable to constantly change a direction in which air is discharged from an air outlet. Yet, the above-described conventional inventions do not provide a mechanism that converts a direction of an outlet.

SUMMARY OF THE DISCLOSURE

Following are technical objects of the present disclosure.

One object of the present disclosure is to provide a dryer including an efficient mechanism in which an air outlet, through which drying air is discharged, can be rotated by a motor.

Another object of the present disclosure is to provide a dryer in which a discharging direction of drying air is converted in a predetermined pattern by the aforementioned mechanism, dispersing the drying air by a predetermined angle, and thereby improving the drying operation.

Yet another object of the present disclosure is to provide a dryer in which a rotational force of the motor can be delivered accurately, while a direction of the air outlet can be easily converted.

Still another object of the present disclosure is to provide a dryer in which the mechanism for converting the direction of the air outlet can be conveniently installed.

Other technical objects of the present disclosure not mentioned herein will be clearly understood from the following description by those skilled in the art to which the inventive concept pertains.

In order to achieve the above objects, the present disclosure provides a dryer including a hollow casing having an open front, a fan configured to introduce air into the casing and blow the air, a heater configured to heat the air introduced into the casing, a discharge tube disposed at a downstream side of the fan to be thereby rotatable inside the casing, and having an air inlet formed at a rear and an air outlet formed at a front, a motor configured to generate power for driving the discharge tube, and having a rotation shaft, and a connector connected to the rotation shaft so as to enable the discharge tube to be rotated about a first axial line of the rotation shaft, and connected to the discharge tube so as to enable the discharge tube to be rotated about a second axial line forming a predetermined angle relative to the first axial line.

A link block may be interposed between the connector and the rotation shaft. The rotation shaft and the connector may be orthogonally connected to the link block. At least one end of the connector may be connected to the discharge tube.

A central axial line of the rotation shaft and a vertical through hole may be formed in the link block. The connector may pass through the through hole in a fixed manner. Both ends of the connector may be connected to the discharge tube.

Both ends of the connector may be formed in a round bar. Both ends may be rotatably inserted into a pair of recessed portions, which is formed in the discharge tube to oppose each other, with reference to the central axial line of the connector.

A pair of opposing holes may be formed in a wall of the discharge tube so that the both ends of the connector are inserted into the pair of holes to be rotatable about the central axial line of the connector.

A cylindrical inner sleeve may be disposed inside the casing. The motor may be mounted to a motor mount that is fixed to the inner sleeve.

The motor mount may include a motor engaging part into which a front end of the motor is inserted to be engaged therewith, and a plate-shaped bracket part fixed to the inner sleeve.

The air outlet of the discharge tube may be formed in a cross-sectional area smaller than a cross-sectional area of the air inlet. The air outlet may be formed in an oblong shape.

The oblong shape may comprise a shape which has different sizes of orthogonal widths, such as a race-track-type (or obround) shape and an elliptical shape.

A protrusion may be formed in the discharge tube in a radially outward direction. A cylindrical guide, having a groove into which the protrusion is inserted upon rotation of the discharge tube so that the protrusion is moved, may be disposed inside the casing. The groove may form a closed curve so that the protrusion is continuously rotated along the groove.

The protrusion may include a pair of protrusions spaced apart by an angle of 180 degrees in a rotation direction of the discharge tube. The groove may be formed in forward and backward waveforms protruding in a lengthwise direction of the discharge tube. The waveforms in portions spaced apart by a phase angle of 180 degrees may be forward and backward waveforms, which are opposite to each other, and the waveforms may be a sine wave.

A virtual line connecting the pair of protrusions may be orthogonal to a virtual straight line connecting the central axial line of the connector.

Other unmentioned technical solutions can be clearly understood from the following description by those having ordinary skill in the technical field to which the present disclosure pertains.

DESCRIPTION OF EXEMPLARY EMBODIMENTS

Figure 1:
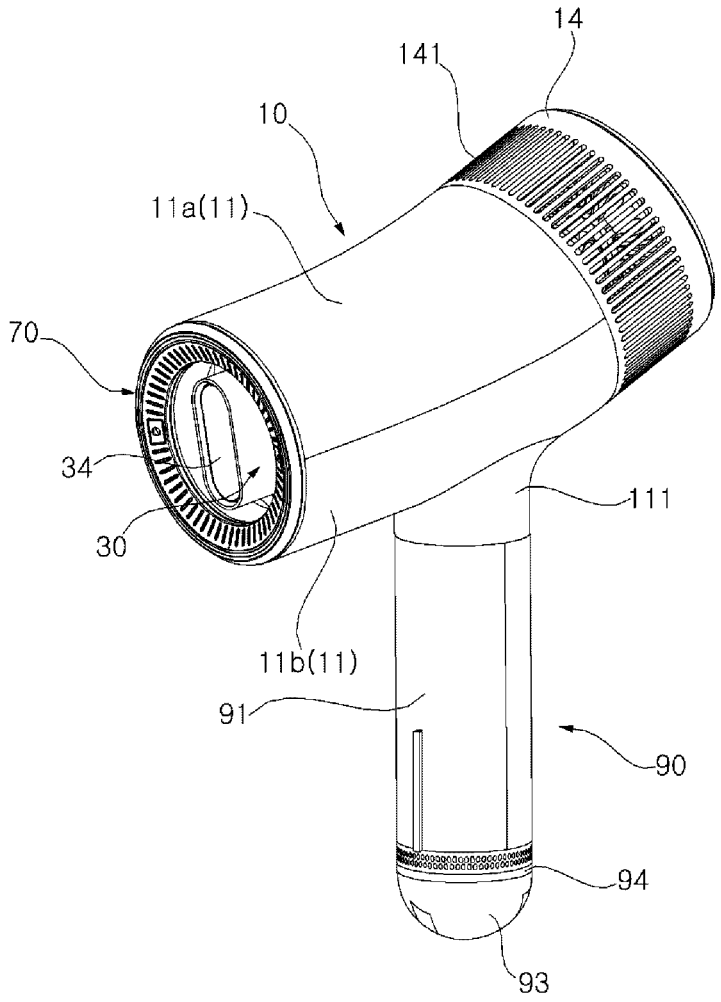
FIG. 1 is a perspective view of a dryer according to an embodiment of the present disclosure.

The advantages and features of the present disclosure and a method of achieving them will become apparent with reference to the embodiments described in detail below together with the accompanying drawings. However, the present disclosure is not limited to the embodiments set forth herein but may be embodied in many different forms, and these embodiments are provided so that the disclosure of the present disclosure is complete and that those skilled in the art will fully understand the scope of the present disclosure, and the present disclosure is only defined by the scope of the claims. Like reference numerals designate like elements throughout the specification.

Hereinafter, a dryer according to an embodiment of the present disclosure will be described with reference to the accompanying drawings.

Figure 2:
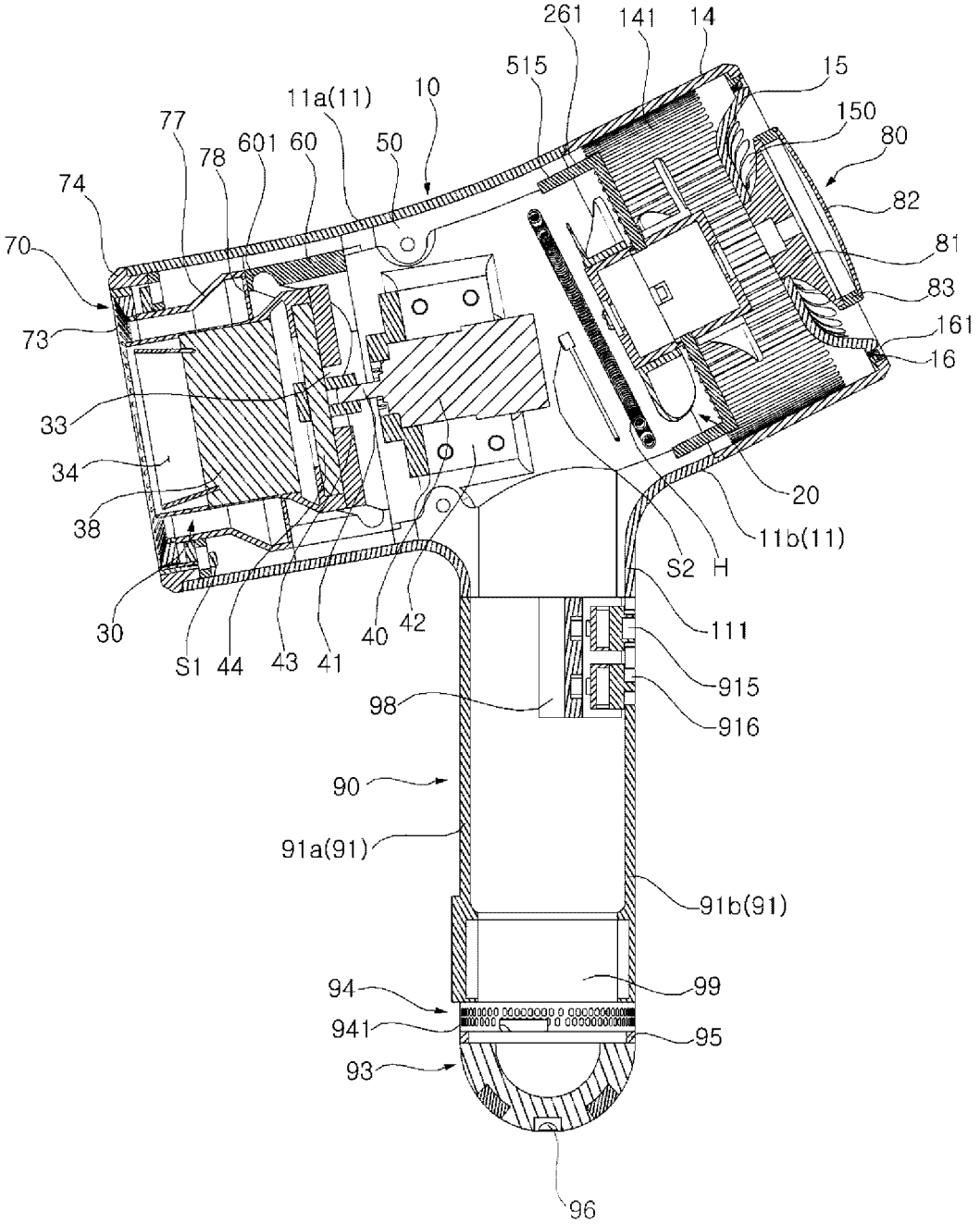
FIG. 2 is a sectional view of the dryer shown in FIG. 1.
Figure 3A:
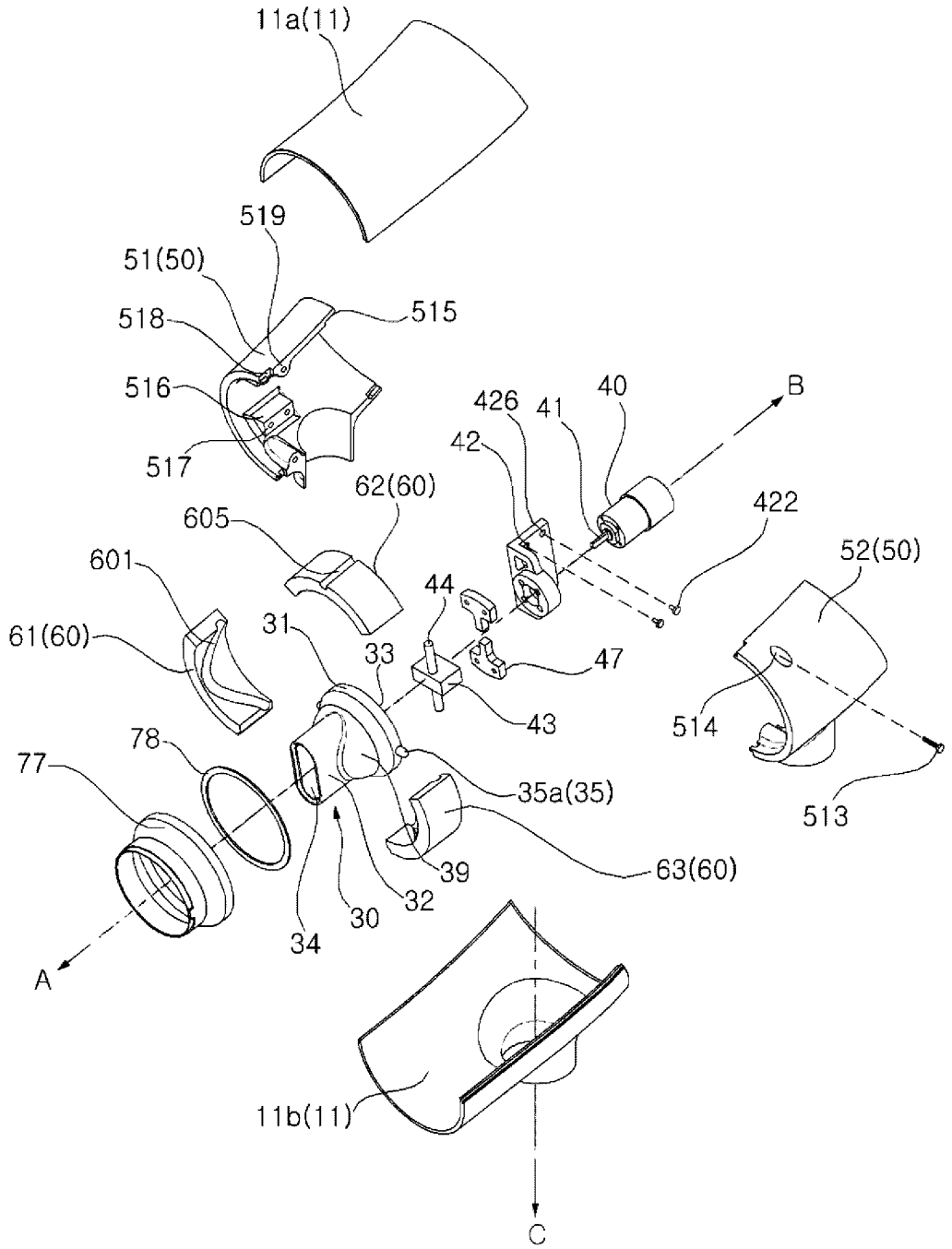
FIGS. 3A to 3D are exploded perspective views of the dryer shown in FIG.

Referring to FIGS. 1, 2 and 3A, a dryer according to an embodiment of the present disclosure includes a hollow casing 10, a fan 20 for introducing external air into the casing 10 and blowing the introduced air, and a heater H installed at a downstream side of the fan 20 for heating the air.

A discharge tube 30 is rotatably installed at a downstream side of the heater H. An air inlet 33 through which heated air is introduced is formed at a rear of the discharge tube 30. An air outlet 34 through which drying air is discharged to an outside is formed at a front of the discharge tube 30. A motor 40 for rotating the discharge tube 30 is installed behind the discharge tube 30.

In addition, the dryer according to an embodiment of the present disclosure may include a lighting device 70 at the front of the dryer for radiating light toward the front of the dryer, a display device 80 at the rear of the dryer for displaying operating information of the dryer or allowing an input to be applied, and a grip 90 extending downwardly from the casing 10.

In addition, the dryer may include an external temperature sensor S1 for sensing a body temperature of a target object or a body part to be dried, an air temperature sensor S2 for sensing temperature of heated air in the casing 10, and a controller 98 for controlling driving of the dryer.

Hereinafter, elements of the dryer according to an embodiment of the present disclosure will be described in more detail.

Referring to FIGS. 1, 2, 3A, and 3C, the casing 10 may include a casing main body 11 forming a cylindrical tube including an upper casing 11*a* and a lower casing 11*b* that are integrally coupled, and a cylindrical cap 14 connected to a rear of the casing main body 11 and having a plurality of through holes 141 formed therein to introduce air.

According to an embodiment of the present disclosure, the casing main body 11 and the cylindrical cap 14 may be made separately and coupled together. Alternatively, the casing main body 11 and the cylindrical cap 14 can be created as an integral one-piece unit.

A rear cover 15 having a plurality of air introducing through holes 150 formed therein may be disposed rearward of the cylindrical cap 14. The rear cover 15 may be inserted into and coupled with an opening formed at the rear of the cylindrical cap 14. Alternatively, a ring 16 having a plurality of air introducing through holes 161 formed therein may be inserted between a periphery of the opening of the cylindrical cap 14 and a periphery of the rear cover 15, so that the cylindrical cap 14, the rear cover 15, and the ring 16 may be coupled together.

The meaning of "coupling" mentioned above or below may refer to a case where two elements are integrally formed or assembled by a well-known coupling technique such as fusion, adhesion, forcible insertion, screw fastening, bolt fastening, and key engagement.

Figure 3B:
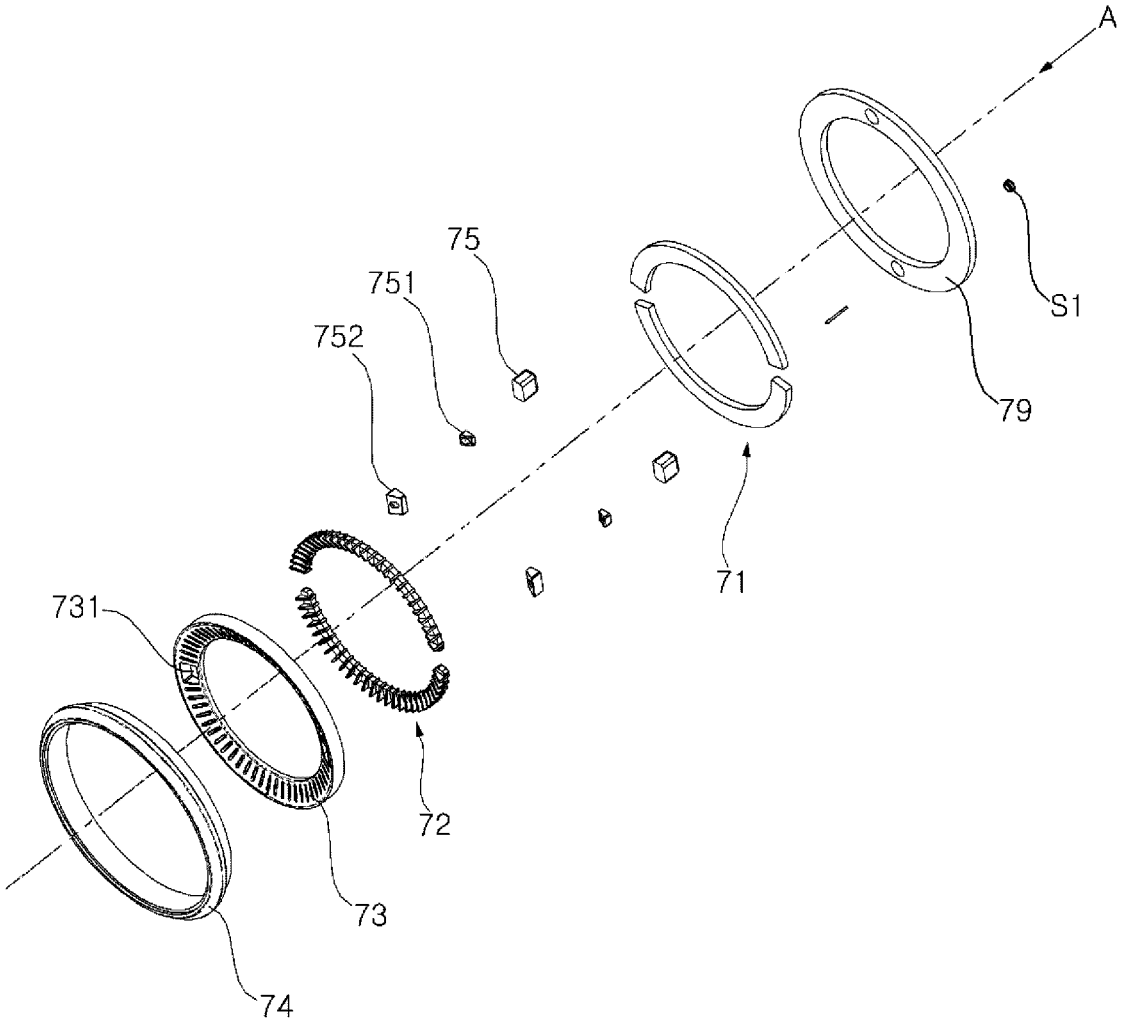
Figure 3C:
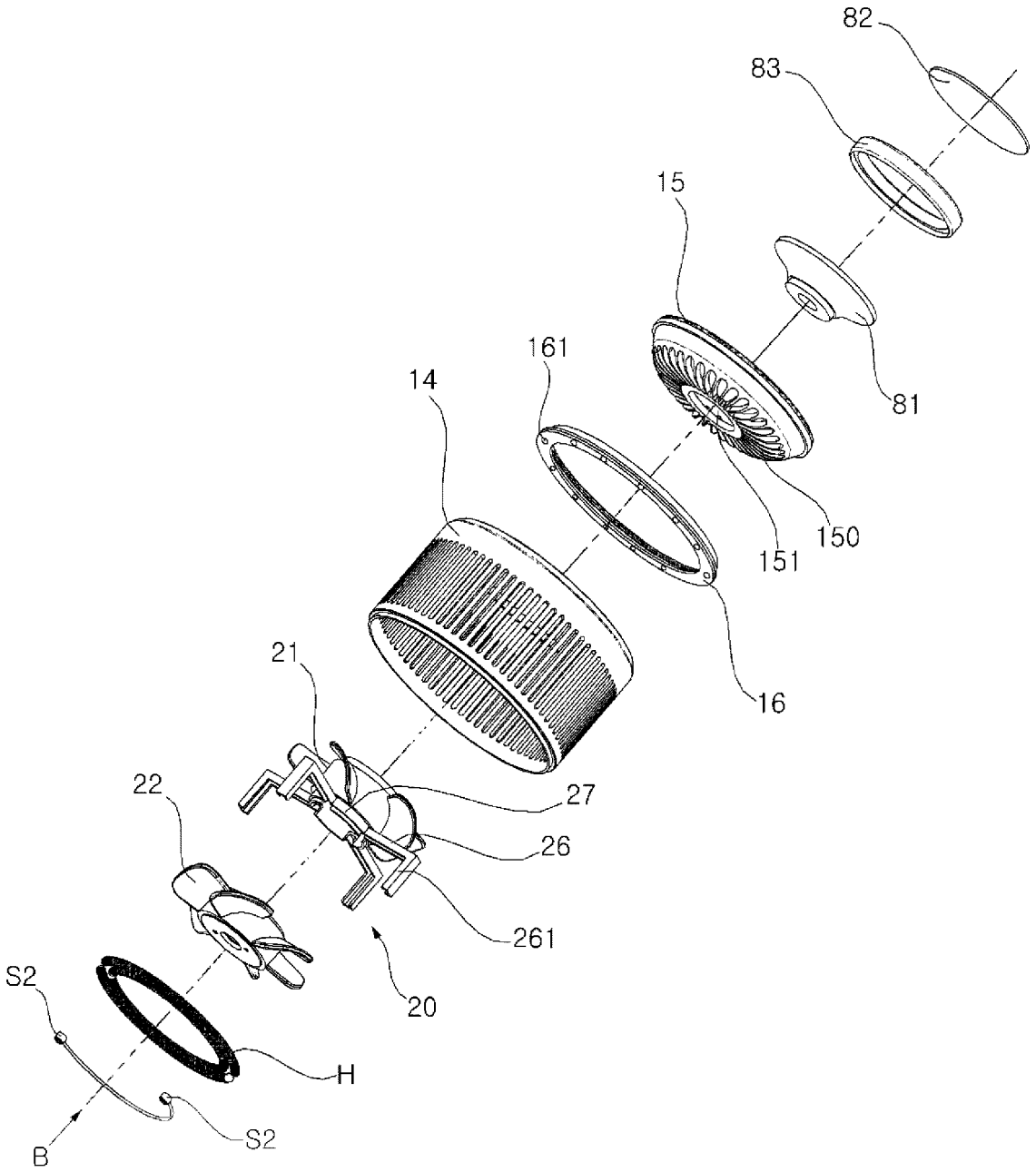

Referring to FIGS. 2 and 3C, the blowing fan 20 may be installed inside the casing 10 and may include a first fan 21 and a second fan 22 disposed at a downstream side of the first fan 21.

A rotational shaft of the first fan 21 and a rotation shaft of the second fan 22 may be arranged on the same axis, and accordingly, the first fan 21 and the second fan 22 may be rotated on the same axis, and the rotation shafts may be separately arranged on the same axis.

In addition, because the first fan 21 is disposed inside the cylindrical cap 14, the first fan 21 may primarily perform a function of introducing external air into the casing 10 through the through holes 141 formed in the cylindrical cap 14, the through holes 150 formed in the rear cover 15, and the through holes 151 formed in the ring 16 when the first fan 21 is rotated.

Because the second fan 22 is disposed at a downstream side of the first fan 21, the second fan 22 may primarily perform a function of sending external air, introduced by the first fan 21, toward the discharge tube 30 at a front side of the casing 10.

In a case where the first fan 21 and the second fan 22 are made to primarily perform functions of an air introducing fan and an air discharge fan, respectively, an amount of air to be introduced and an amount of air to be blown may increase, but air blowing noise may be reduced, and thereby the dryer may operate quietly.

In addition, by operating only one of the first fan 21 and the second fan 22, it is possible to reduce an amount of drying air to be discharged from the dryer.

By rotating the first fan 21 and the second fan 22 so that the first fan 21 and the second fan 22 are rotated in directions opposite to each other, air may be introduced and blown more efficiently.

A fan mount 27 may be installed between the first fan 21 and the second fan 22. In the fan mount 27, a plurality of rods 26 may protrude outwardly, and then end portions 261 of the respective rods 26 may be bent. The bent end portions 261 of the rods 26 may be forcibly inserted into groves 515 formed in an inner sleeve 50, so that the fan 20 may be fixed at a predetermined location inside the casing 10.

The heater H installed at a downstream side of the fan 20 may be formed as a ring-shaped coil heater, and heats air blown from the fan 20. The air temperature sensor S2 may be installed at a downstream side of the heater H. The air temperature sensor S2 may be provided as a pair of sensors on the left and right sides in front of the heater H (see FIG. 3C).

Referring to FIGS. 2, 3A, 4 and 5, the cylindrical inner sleeve 50 may be disposed inside the casing main body 11 composed of the upper casing 11*a* and the lower casing 11*b*. An outer circumferential surface of the inner sleeve 50 may be coupled with an inner circumferential surface of the casing main body 11 while brought into contact with the inner circumferential surface of the casing main body 11.

Referring to FIG. 3A, the inner sleeve 50 may be made as left and right sleeve pieces 51 and 52 which can be assembled in a manner in which a set screw 513 is fastened into a screw opening 519 formed in the left sleeve piece 51 through an opening 514 formed in the right sleeve piece 52.

In addition, referring to FIGS. 2 and 3A, the grooves 515 may be formed at a rear of the inner sleeve 50 and the bent end portions 261 of the rods of the fan 20 may be forcibly inserted into the grooves 515, so that the fan 20 is fixed at a predetermined location inside the casing 10 (see FIG. 2).

In addition, a protruding portion 516 may be formed at an inner circumferential surface of the left sleeve piece 51, and a screw opening 517 may be formed in the protruding portion 516. A screw 422 may penetrate a motor mount 42, and may be screw-coupled with the screw opening 517, so that the motor 40 is fixed at a predetermined location inside the casing main body 11.

Referring to FIGS. 2, 3A, 5 and 6, the discharge tube 30 may be generally formed in a shape of which a front side is small and a rear side is funnel-shaped. The rear part of the discharge tube 30 may be formed as a cylindrical part 31, and the front part of the discharge tube 30 may be formed as a predetermined pipe portion 32. A flared portion 39, in which a sectional area is gradually reduced toward the front of the discharge tube 30, may be formed between the front and the rear of the discharge tube 30.

The air inlet 33 in a circular shape may be formed inside the cylindrical part 31 of the discharge tube 30. The pipe portion 32 may be formed in an oblong pillar shape. The air outlet 34 having an oblong shape may be formed at a front side of the discharge tube 30.

The meaning of "oblong" mentioned above is not just a rectangle, but also a shape which has different sizes of orthogonal widths, such as a race-track-type shape and an elliptical shape.

In addition, although the air inlet 33 formed in the discharge tube 30 is in a circular shape and the air outlet 34 is in an oblong shape according to the present disclosure, aspects of the present disclosure are not limited thereto, and the air inlet 33 and the air outlet 34 maybe modified into various shapes.

Because the air outlet 34 of the discharge tube 30 does not have a large size and is smaller in size than the air inlet 33, air may be concentrated from the air outlet 34 and discharged to the outside.

A partition 38 may be disposed to partition an air passage formed inside the discharge tube 30, so that discharged air is dispersed.

In addition, although not shown in the drawings, the air outlet 34 may be formed in a circular shape and may be asymmetrical with respect to a central rotation line of the discharge tube 30, or may be eccentric to the central rotation shaft.

Figure 6:
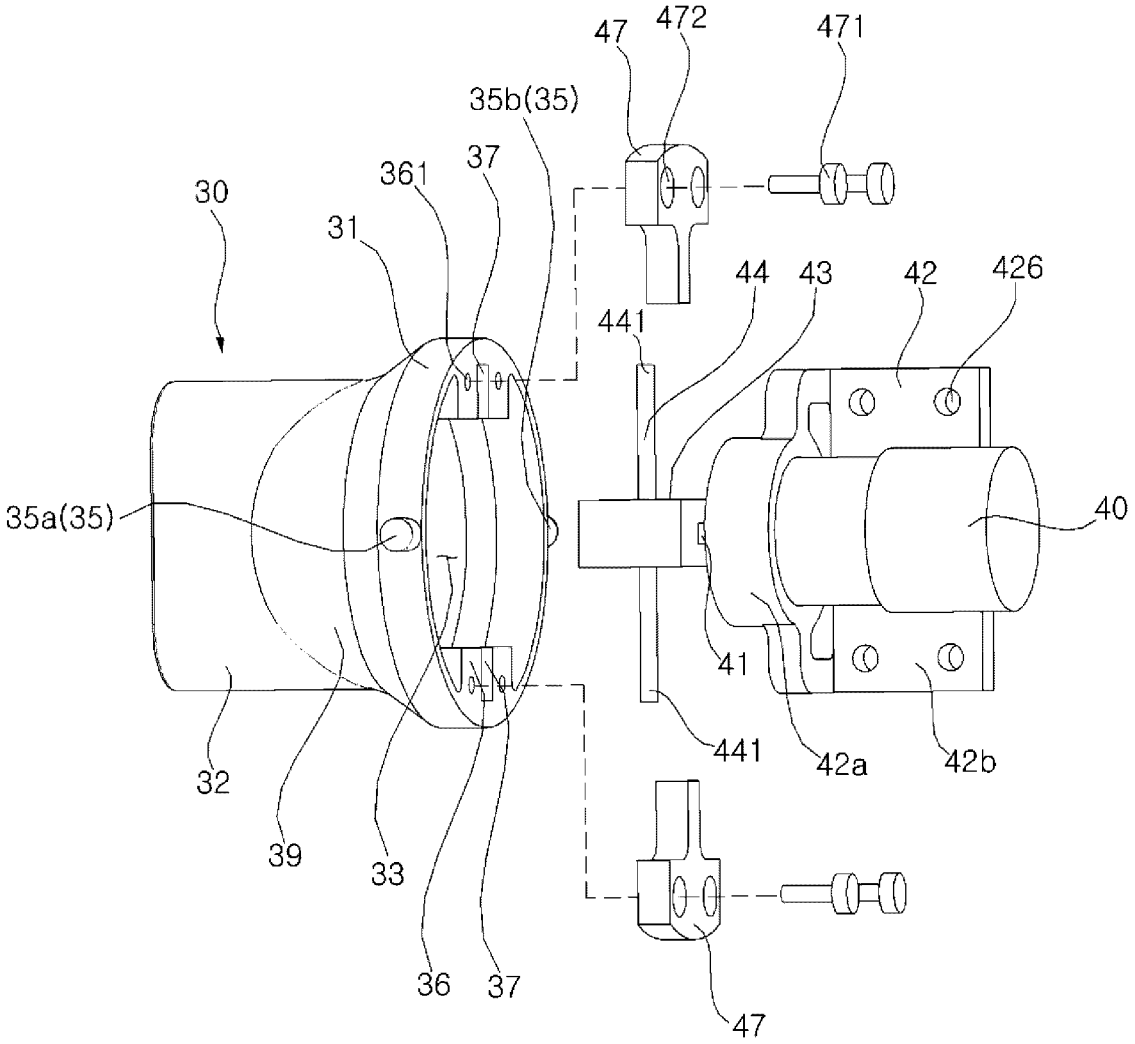
FIG. 6 is an exploded perspective view of a discharge tube and a motor included in an embodiment of the present disclosure.
Figure 7:
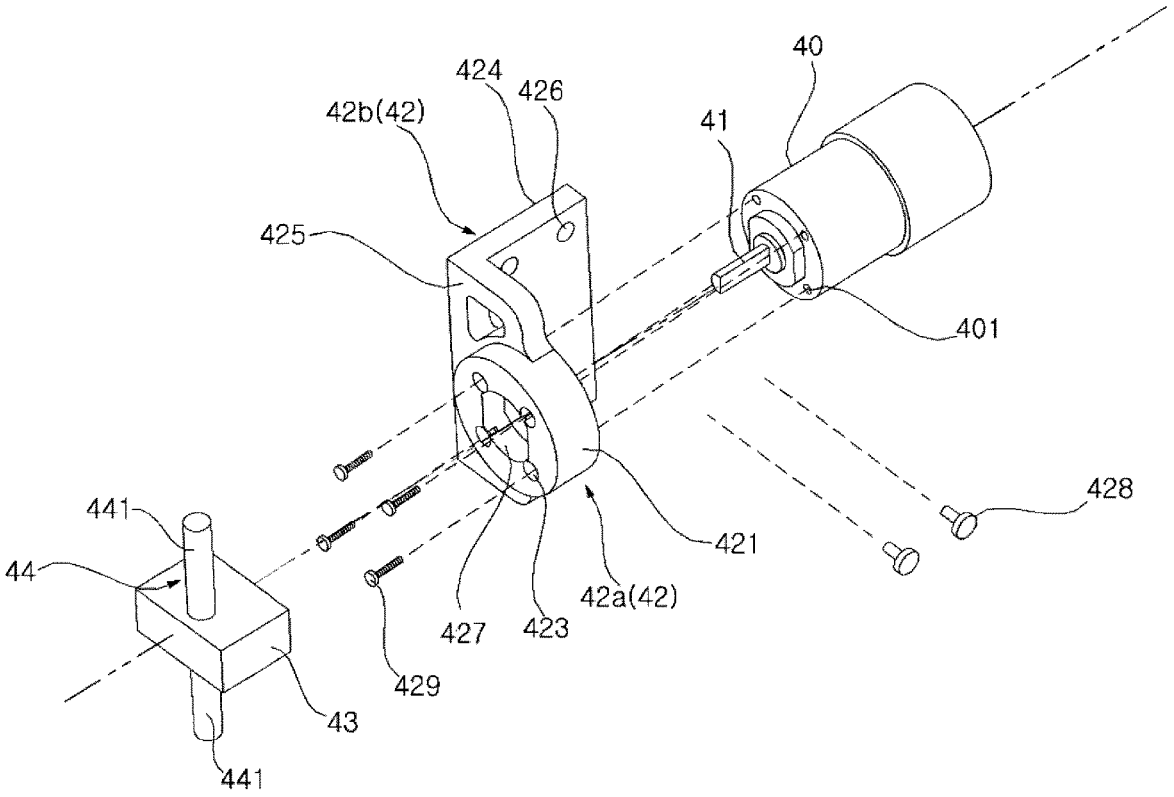
FIG. 7 is an exploded perspective view of the motor shown in FIG. 6.
Figure 8:
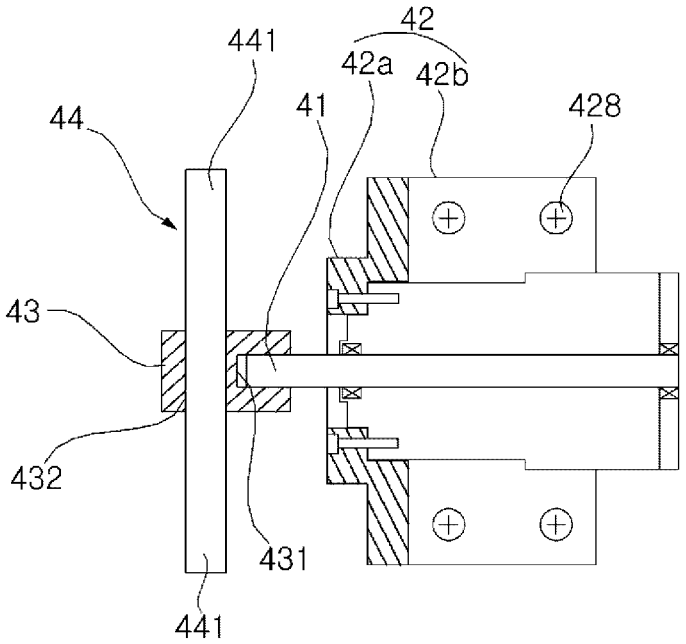
FIG. 8 is a cross-sectional view of the motor shown in FIG. 7.

Referring to FIG. 6, a pair of protrusions 35 may be formed in the cylindrical part 31 of the discharge tube 30 to protrude outwardly 180 degrees apart from one another. The pair of protrusions 35 may be slidably inserted into a groove 601 of a cylindrical guide 60 (see FIG. 3A).

Referring to FIGS. 2 to 5, the cylindrical guide 60 may be disposed in front of the inner sleeve 50. Referring to FIG. 3A, three pieces 61, 62, and 63 may be coupled to each other to form the cylindrical guide 60.

Because the groove 601 is formed in an inner surface of the cylindrical guide 60, the protrusions 35 of the discharge tube 30 may be inserted into the groove 601 in a sliding manner. The groove 601 may form a closed curve so that the protrusions 35 are rotated while the discharge tube 30 is rotated.

Figure 9:
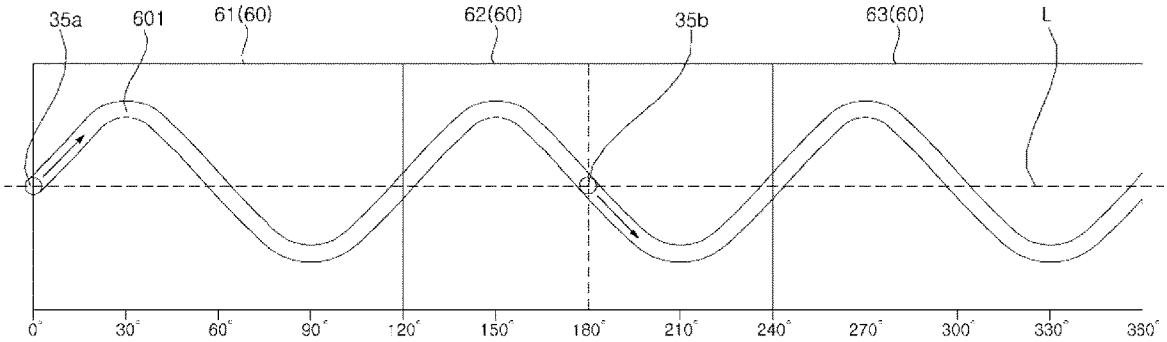
FIG. 9 is a development view of an interior of a cylindrical guide included in an embodiment of the present disclosure.

The groove 601 may be formed as a waveform if an inner circumferential surface of the guide 60 was flattened, as shown in FIG. 9. The waveform may be a sine wave.

The cylindrical guide 60 may be disposed in front of the inner sleeve 50 and coupled to the inner sleeve 50, or may be pressed inwardly along with the inner sleeve 50 by an inner circumferential surface of the casing main body 11 and thereby fixed to the inside of the casing 10.

The casing main body 11, the inner sleeve 50, and the cylindrical guide 60 may be manufactured individually and coupled to each other, as shown in the embodiment of the present disclosure. Alternatively, the casing main body 11, the inner sleeve 50, and the cylindrical guide 60 may be manufactured integrally as a one-piece integral unit, or two of the casing main body 11, the inner sleeve 50, and the cylindrical guide 60 may be manufactured integrally and coupled to the remaining one of them.

In FIG. 3A, reference numerals 518 and 605 respectively indicate a cut-off portion 518 formed in the inner sleeve 50 and a groove 605 formed in the cylindrical guide 60, through which a cable is allowed to pass.

A pair of inwardly protruding blocks 36 may protrude inwardly of the cylindrical part 31 of the discharge tube 30 to oppose each other, and a recessed portion 37 may be formed in each of the inwardly protruding blocks 36.

The pair of recessed portions 37 may be arranged at 180 degrees to oppose each other, and the pair of protrusions 35 and the pair of recessed portions 37 may be arranged so that a virtual straight line connecting the pair of recessed portions 37 is orthogonal to a virtual straight line connecting the pair of protrusions 35. A connector 44 of a motor described below may be inserted into the recessed portions 37.

Referring to FIG. 2, 3A and 5 to 8, the motor 40 rotating the discharge tube 30 may be fixed to the motor mount 42, and the motor mount 42 may be fixed to a sleeve piece 51 of the inner sleeve 50.

The motor mount 42 may include a motor engaging part 42*a*, and a bracket part 42*b* integrally formed with the motor engaging part 42*a* to be thereby fastened with the inner sleeve 50.

The motor engaging part 42*a* may formed as a cylindrical pipe portion 421 into which at least a front end of the motor 40 is inserted. A screw 429 is screw-engaged with a screw opening 401 formed at a front of the motor 40 through a hole 423 formed in the pipe portion 421 so that the motor 40 is engaged with the motor engaging part 42*a*. A rotation shaft 41 of the motor 40 protrudes forward through a hollow portion 427 formed in the motor engaging part 42*a*.

The bracket part 42*b* includes a connecting portion 425 protruding outwardly from the motor engaging part 42*a*, and a plate body portion 424 bent rearwardly from one side of the connecting portion 425.

A set screw 428 is screw-engaged with a screw opening 517, formed in a protrusion 516 of the left sleeve piece 51, through a through hole 426 formed in the plate body portion 424, whereby the bracket part 42*b* may be affixed to the inner sleeve 50, and therefore the motor 40 may be fixed at a predetermined location in the inner sleeve 50.

A power transfer device for transferring a rotational force of the motor 40 to the discharge tube 30 may include a rectangular link block 43 connected to the rotation shaft 41 of the motor 40 to be fixed thereto, and a round bar-shaped connector 44 disposed orthogonally to the rotation shaft 41 and penetrating the link block 43 so that both ends 441 of the connector 44 protrude outwardly of the link block 43.

The rotation shaft 41 is inserted into a horizontal opening 431 formed in one side of the link block 43 to be thereby fixed thereto, and the connector 44 penetrates a through hole 432 that is vertically formed in the link block 43.

The connector 44 may be connected to the link block 43 in a rotatable manner or may be connected to the link block 43 in a fixed manner.

Both ends 441 of the connector 44 may be inserted into the recessed portion 37 of the discharge tube 30 so that the discharge tube 30 is rotated in a rotation direction of the rotation shaft 41 when the motor 40 is driven.

Both ends 441 of the connector 44 may be inserted into the recessed portion 37 in a rotatable manner or in a fixed manner. In a case where the connector 44 is fixed to the link block 43, both ends 441 of the connector 44 may be inserted into the recessed portion 37 in a rotatable manner, and accordingly, the connector 44 and the discharge tube 30 may be connected to each other to be thereby rotated relative to each other with reference to a central axial line of the connector 44.

After both ends 441 of the connector 44 are inserted into the recessed portion 37 of the discharge tube 30, a stopper 47 may be engaged with an inwardly protruding block 36 of the discharge tube 30. More specifically, a screw 471 is screw-engaged with a screw opening 361 formed in the inwardly protruding block 36 through a hole 472 formed in the stopper 47, so that the stopper 47 may be engaged with the discharge tube 30.

The discharge tube 30 and the motor 40 are connected as above, whereby the connector 44 may be rotated upon rotation of the motor 40, and the discharge tube 30 may rotate upon the rotation of the connector 44. At this point, a pair of protrusions 35 protruding outwardly from the cylindrical part 31 of the discharge tube 30 is inserted into a groove 601 formed in an inner circumferential surface of the cylindrical guide 60 to thereby slide along the groove 601. Thus, the discharge tube 30 may rotate in a rotation direction of the rotation shaft 41 along with the connector 44, while rotating forward and backward at a predetermined angle with respect to the central axial line of the connector 44.

Figure 10:
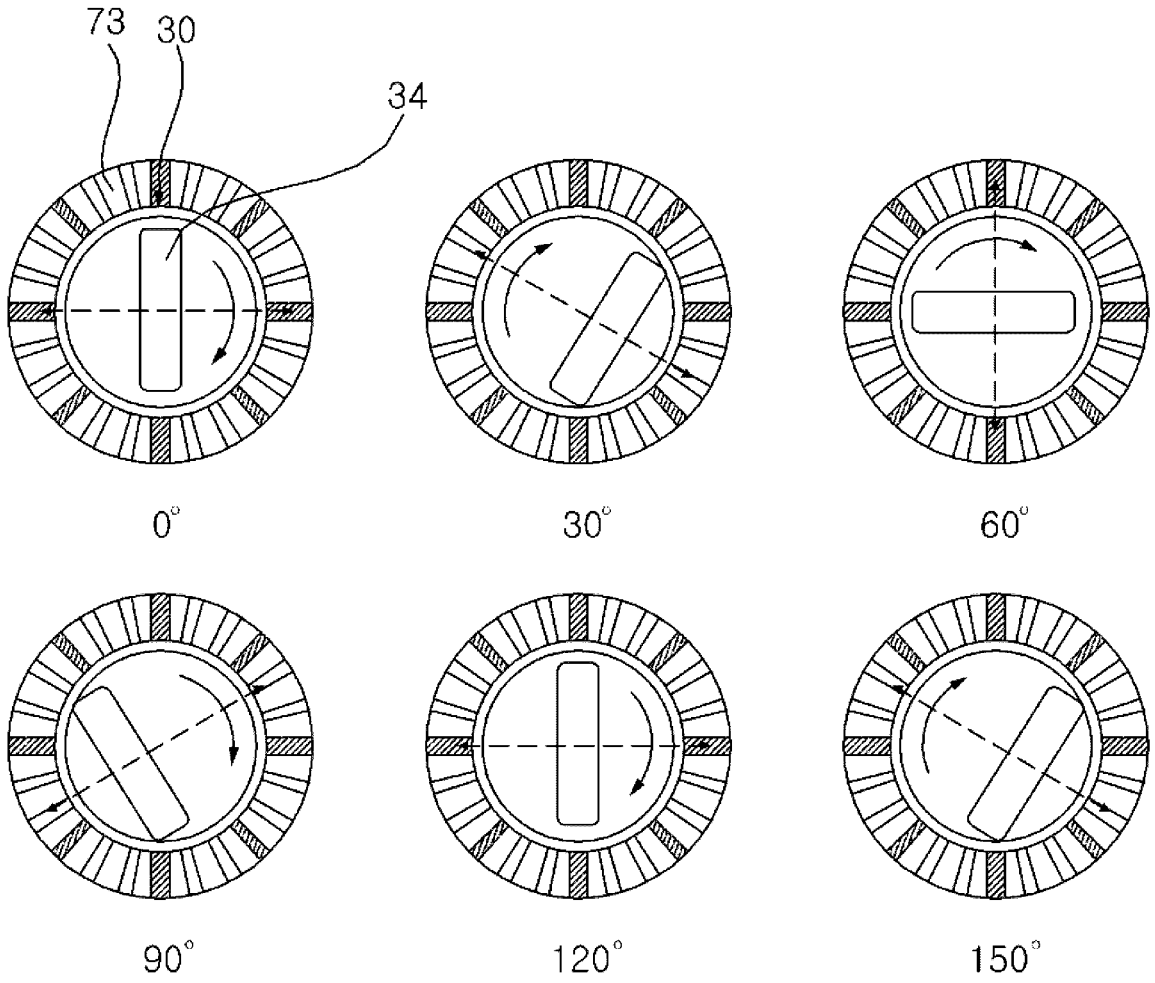
FIG. 10 shows rotating steps of a discharge tube included in an embodiment of the present disclosure.

Referring to FIGS. 9 and 10, a further detailed description will be provided.

FIG. 9 is a view showing a flattened inner surface of the cylindrical guide 60. Reference numerals 61, 62, and 63 indicates a first piece, a second piece, and a third piece of the cylindrical guide 60. Reference numeral 601 indicates a groove formed in the inner surface of the cylindrical guide 60. Reference numerals 35*a* and 35*b* indicate a pair of protrusions formed on the discharge tube 30. An angle indicates a phase angle in a range of 360 degrees from 0 degrees. In addition, a period of a waveform formed by the groove 601 shown in FIG. 9 is 120 degrees, the waveform which is symmetrical in a forward direction and a backward direction with reference to a reference line L in two parts having a phase angle of 180 degrees.

When the motor 40 is driven, the discharge tube 30 is rotated and the pair of protrusions 35*a* and 35*b* on the discharge tube 30 moves along the groove 601 as well. When the pair of protrusions 35*a* and 35*b* are at positions of 0° and 180° relative to the groove 601, the protrusions are placed at the reference line L at the same height, and thus, the air outlet 34 of the discharge tube 30 may be positioned at the center in a vertical direction, for example, at 0° as shown in FIG. 9. At such positions, the pair of protrusion 35*a* and 35*b* move in an arrow direction as the discharge tube 30 is rotated in a rotation direction of the rotation shaft 41. Thus, when the height of the pair of the protrusions 35*a* and 35*b* are tilted toward the opposite sides from the reference line L and rotated by 30 degrees, the pair of protrusions 35*a* and 35*b* may be positioned farthest from the reference line L to oppose each other. Then, when the pair of the protrusions 35*a* and 35*b* are rotated to 60° from the initial position, the pair of the protrusions 35*a* and 35*b* may be positioned on the reference line L again. Then, when the pair of the protrusions 35*a* and 35*b* are rotated further to 90 degrees, the pair of protrusions 35*a* and 35*b* are tilted farthest from the reference line. Then, when the pair of the protrusions 35*a* and 35*b* are further rotated to 120 degrees, the pair of the protrusions 35*a* and 35*b* may be positioned on the reference line L. Then, the above-described movement is performed repeatedly.

Thus, when the rotation shaft 41 is rotated, the discharge tube 30 is rotated in the rotation direction of the rotation shaft 41 by a predetermined angle relative to a central axial line of the connector 44. Accordingly, while the air outlet 34 of the discharge tube 30 is rotated, a position of the air outlet 34 of the discharge tube 30 may be changed toward one side from a center of the rotation and then the position may be changed toward the other side again (see FIG. 10). Therefore, drying air to be discharged from the air outlet 34 may be dispersed to a wider area upon change of a discharge angle, and an area to dry may be widely extended.

In a case where the discharge tube 30 is not rotated when the motor 40 is stopped, a direction of air being discharged from the air outlet 34 does not change. Since the air outlet 34 of the discharge tube 30 is smaller in size than the air inlet 33, concentrated drying air may be discharged through the air outlet 34. When the motor 40 is driven, the discharge tube 30 is rotated and accordingly drying air discharged from the air outlet 34 upon the rotation of the discharge tube 30 may be dispersed. That is, as driving of the motor 40 is controlled, air may be discharged concentratedly or dispersedly toward a drying target, when necessary.

Figure 11:
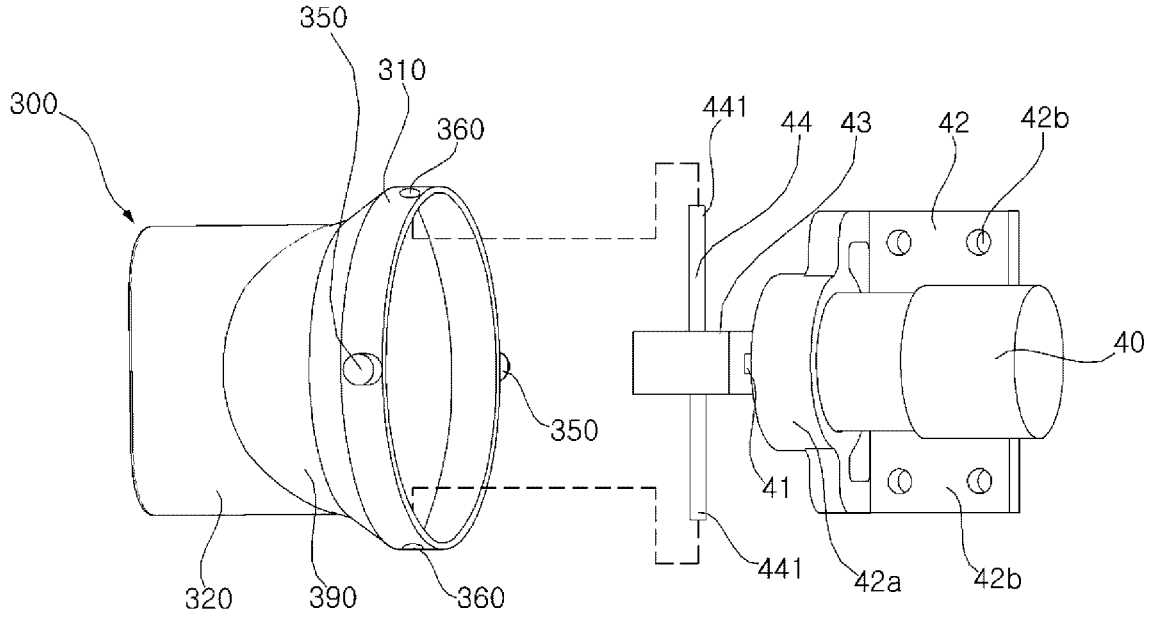
FIG. 11 is a perspective view of a discharge tube and a motor according to another embodiment of the present disclosure.
Figure 12:
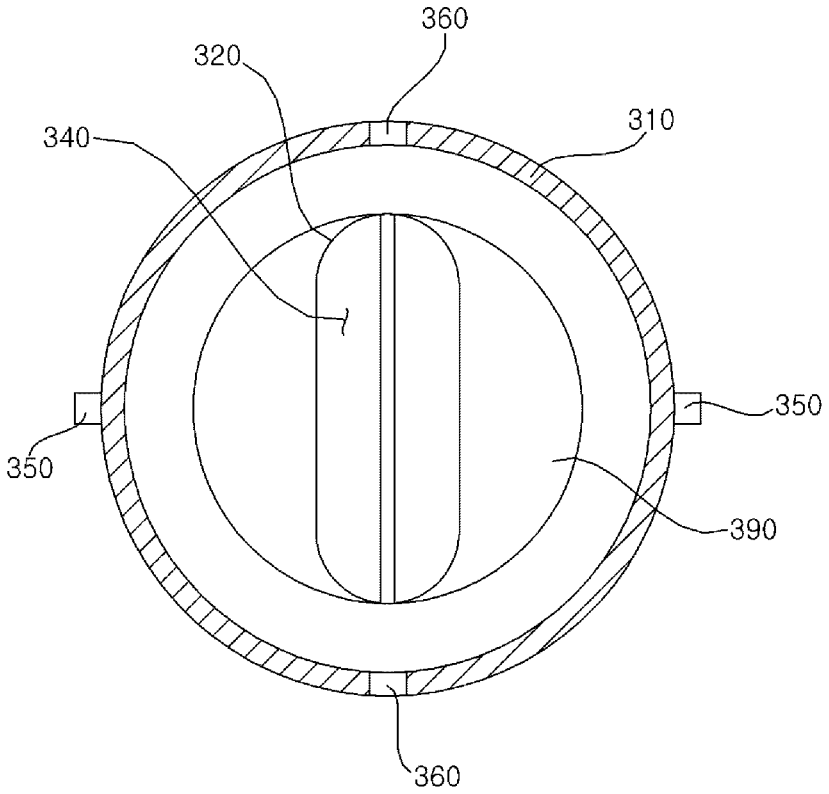
FIG. 12 is a cross-sectional view of the discharge tube shown in FIG. 11.

A coupling configuration between a discharge tube and a motor according to another embodiment of the present disclosure is shown in FIGS. 11 and 12.

A discharge tube 300 shown in FIG. 11 may include a cylindrical part 310 at a rear of the discharge tube 300 as in the above-described embodiment, an oblong body part 320 at a front of the discharge tube 300, and a funnel-shaped flared part 390 formed between the front and the rear of the discharge tube 300. A circular air inlet and an oblong air outlet may be formed in the discharge tube 300.

A pair of holes 360 opposing each other may be formed in the cylindrical part 310, and both ends 441 of a connector 44 may be inserted into the holes 360 in a rotatable manner.

According to this embodiment, the holes 360 are formed to penetrate the cylindrical part 310 is described. Alternatively, at least one of the holes 360 may not penetrate the cylindrical part 310 and may be formed as a groove recessed outwardly from an inner surface of the cylindrical part 310.

The motor 40 may include the rotation shaft 41 as shown in the above-described embodiment, and may be engaged with the motor mount 42 that is mounted to the inner sleeve 50.

At least one protrusion 350 may be formed on the discharge tube 300 and thus inserted into a groove 601 in a movable manner.

Referring to FIGS. 2, 3A, 4 and 5, a discharge cover 77 may be formed in a cylindrical shape so as to accommodate in the discharge tube 30 between the front of the casing main body 11 and the discharge tube 30, and may be disposed in a fixed manner. The front of the discharge tube 30 may be positioned in an inner side of the discharge cover 77.

A rear end of the discharge cover 77 may be coupled to a front end of the aforementioned cylindrical guide 60, and a front end of the discharge cover 77 may extend forward to a front end of the casing main body 11.

A ring-shaped sealing 78 is interposed between the rear end of the discharge cover 77 and the discharge tube 30, so that air blown from the fan 20 is prevented from leaking to the outside between the discharge cover 77 and the discharge tube 30.

An outer circumferential surface of the sealing 78 may be fixed to the discharge cover 77 in a fixed manner, and an inner circumferential surface of the sealing 78 may be disposed in an unfixed manner so that the discharge tube 30 can be rotated without interference with the sealing 78.

Referring to FIGS. 2 and 3B, a fixing ring 79 may be protrusion-inserted into the discharge cover 77, and thus, the fixing ring 79 may be interposed between the discharge cover 77 and the casing main body 11.

The external temperature sensor S1 may be installed behind the fixing ring 79. The external temperature sensor S1 may sense a temperature of a drying target that is hit by drying air discharged from the air outlet 34 of the discharge tube 30.

The lighting device 70 may be disposed in front of the fixing ring 79. The lighting device 70 may include a light emitting panel 71, a light diffusing module 72, a light guide 73, and a front cap 74.

The light emitting panel 71 may be a light emitting diode (LED) panel in which at least one LED module is disposed. Two semi-circular panel pieces may be disposed to form one ring-type light emitting panel 71. The light emitting panel 71 may be coupled to the fixing ring 79.

The light diffusing module 72 may be disposed in front of the light emitting panel 71. The light diffusing module 72 may be formed as a light guide sheet that can radiate light by dispersing light emitted from the light emitting panel 71. Similar to the light emitting panel 71, two semi-circular module pieces may be disposed to form one ring-type light diffusing module.

A ring-type light guide 73 may be disposed in front of the light diffusing module 72, so that light having passed through the light diffusing module 72 is guided by the light guide 73 in a forward direction and thereby radiated in a dispersed manner.

The front cap 74 may be inserted to a front opening of the casing main body 11 to thereby cover the front opening. The light emitting panel 71, the light diffusing module 72 and the light guide 73 may be interposed between the front cap 74 and the discharge cover 77.

A pair of ionizers 75 may be disposed at the light emitting panel 71 and/or the light diffusing module 72. An ionizer cover 752 having a nozzle 751 inserted therein may be inserted into an opening 731 formed in the light guide 73, so that negative ions discharged from the ionizers 75 are discharged from the front of the dryer.

Accordingly, when drying air is discharged to a drying target object, plasma is discharged and thus positive and negative ions are generated. Therefore, hazardous matters such as various bacteria contained in the air may be removed, dust or the like in the air may be neutralized and coarsened to thereby prevent foreign substances such as dust or the like from being attached to the drying target object, and skin and hair of the target object may be kept moisturized.

Figure 5:
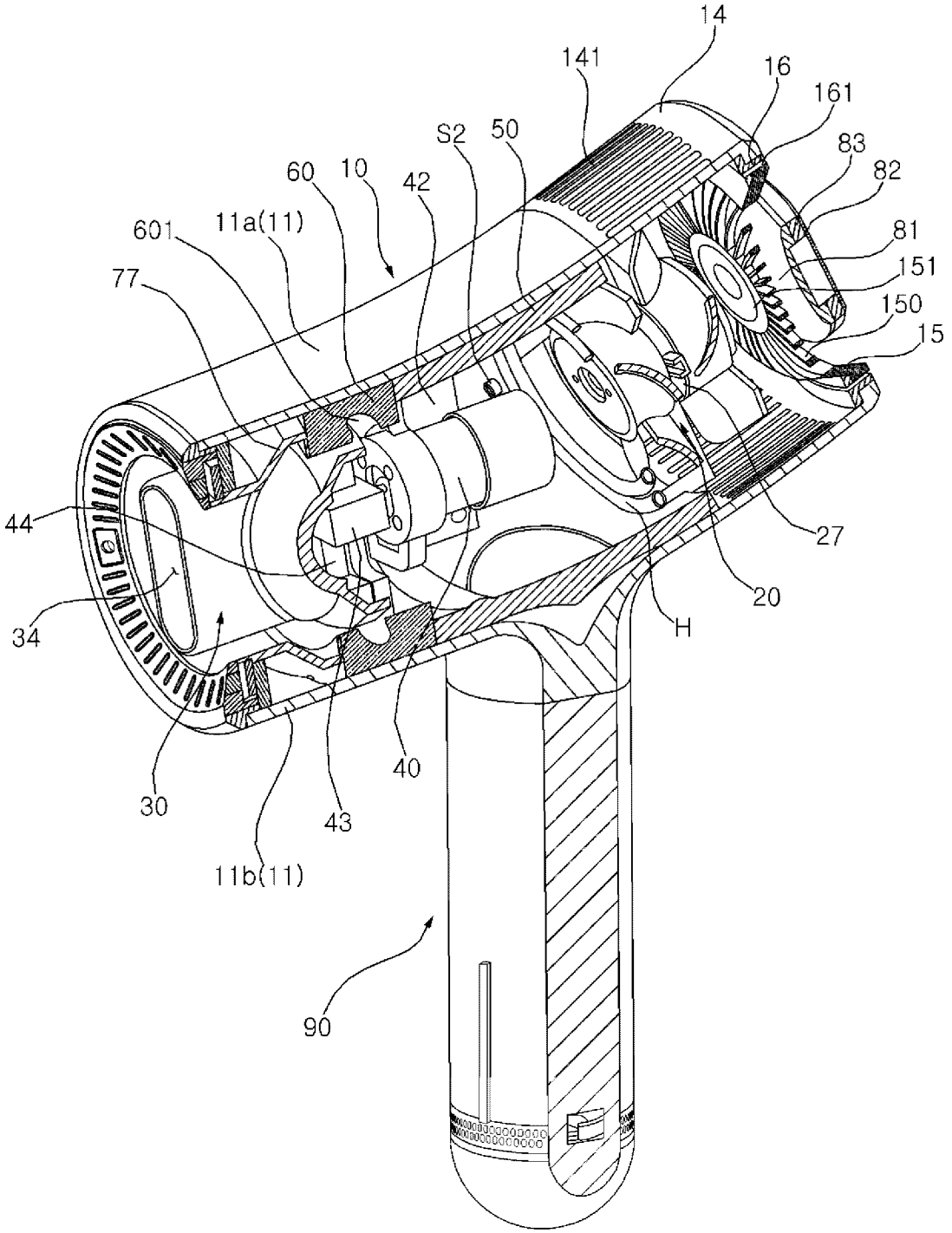
FIG. 5 is a cut-away perspective view showing an internal configuration of a dryer according to an embodiment of the present disclosure.

Referring to FIGS. 2, 3C and 5, the display device 80 installed at the rear of the dryer may include a fixing base 81 having one end inserted into and coupled to an opening 151 formed at a center of the aforementioned rear cover 15, a display panel 82 disposed at a rear of the fixing base 81 to display various kinds of information, and a deco ring 83 for coupling the fixing base 81 and the display panel 82 together.

The display panel 82 may be formed as a touch panel and may display various operating factors, which are directly input by a user, such as a heating temperature of drying air, a discharge rate, a drying duration, etc. In addition, the display panel 82 may receive information necessary for operating from an external input device, such as heating temperature appropriate for a drying target object, a drying duration, etc., and may display the received information.

Accordingly, a user may perform a drying operation while easily recognizing current operating information displayed on the display panel 82, and may receive operation information such as an optimal temperature for drying air, an amount of wind, a wind speed, a drying duration, etc., according to a drying target object, and perform a different optimal operation according to each drying target object.

Figure 3D:
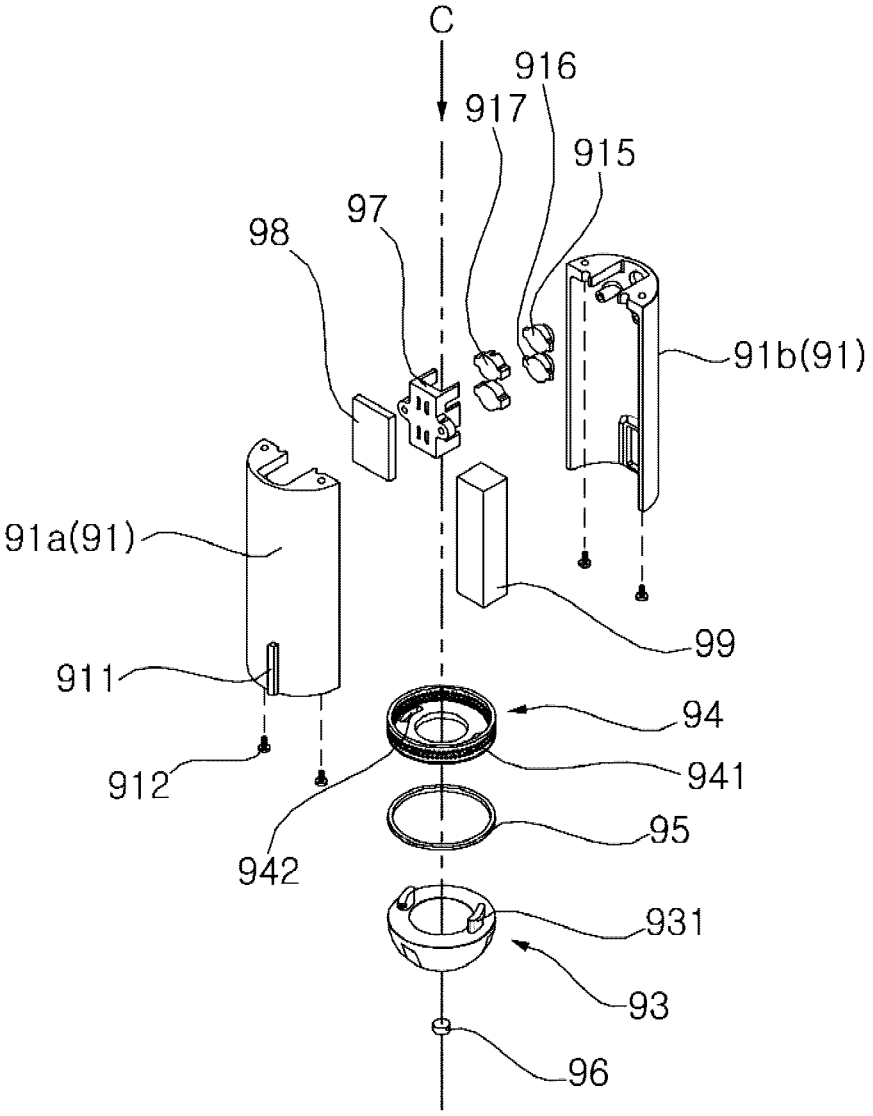
Figure 4:
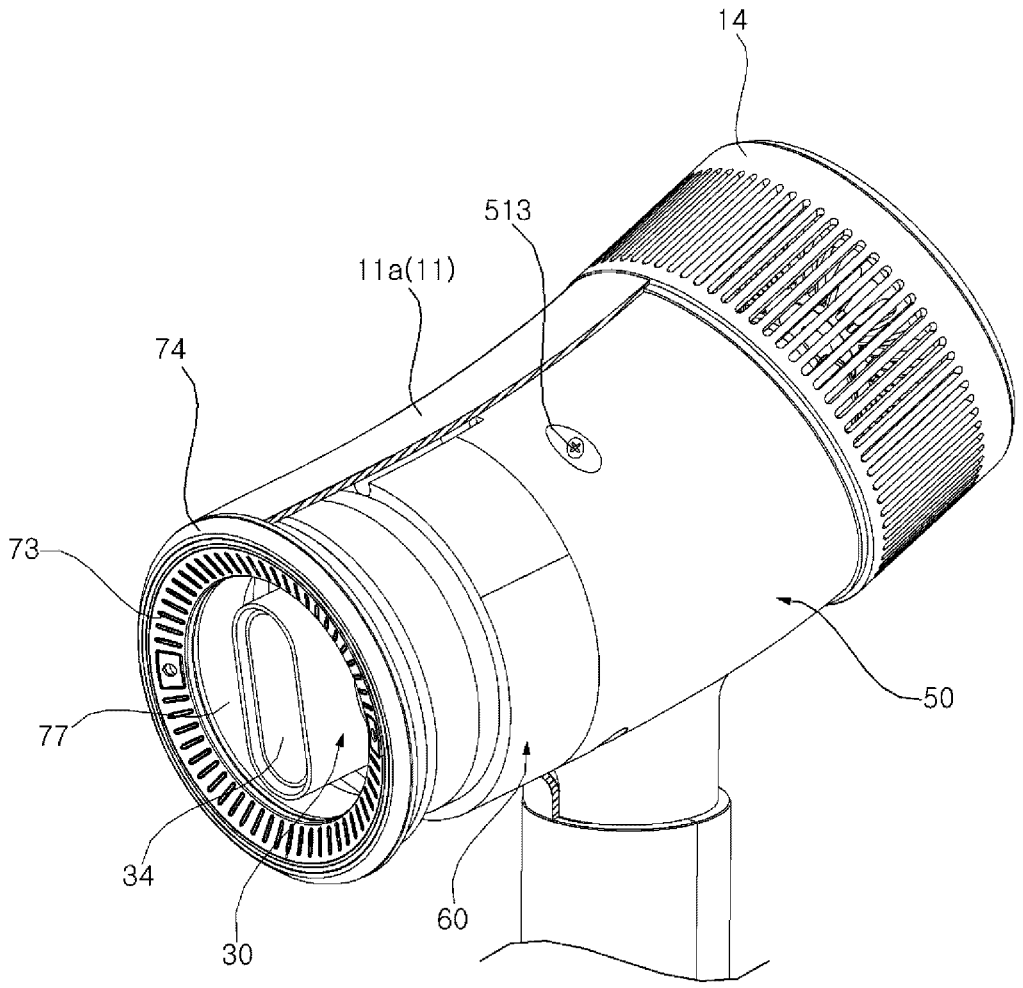
FIG. 4 is a perspective view of a casing shown in FIG. 1, the casing being partially cut-away.

Referring to FIGS. 2 and 3D, the grip 90 coupled to a lower side of the casing 10 may be formed as semi-circular left and right grip pieces 91*a* and 91*b*. The grip 90 may include a grip main body 91 and a lower cover 93 coupled to the lower side of the grip main body 91.

The left and right grip pieces 91*a* and 91*b* may be coupled to a lower extension portion 111, which protrudes from the lower side of the casing main body 11, by a set screw 912. The lower cover 93 may be assembled with the grip main body 91 by an insertion protrusion 931 that protrudes upwardly from an upper surface of the lower cover 93.

A heat dissipating cap 94 having dissipation through holes 941 punched therein may be interposed between the grip main body 91 and the lower cover 93.

An upper surface of the heat dissipating cap 94 may be welded with a lower side of the grip main body 91. The insertion protrusion 931 of the lower cover 93 may be forcibly inserted into a hole 942 in the heat dissipating cap 94 and thereby coupled to the heat dissipating cap 94.

A ring-shaped first electrical terminal 95 may be interposed between the heat dissipating cap 94 and the lower cover 93. A second electrical terminal 96 may be disposed at the center of the bottom of the lower cover 93. The first electrical terminal 95 and the second electrical terminal 96 may be electrically connected to an external power source.

An elongated protrusion 911 may be located on the outside of the left grip piece 91*a*, and two touch buttons 915 and 916 may be vertically installed in the right grip piece 91*b*. A button case 917 and a button housing 97 may be mounted in front of the right grip piece 91*b*.

One of the touch buttons 915 and 916 is an ON/OFF switch of the dryer, and the other one of the touch buttons 915 and 916 may be an ON/OFF switch of the motor 40.

In addition, a controller 98 may be disposed inside the grip main body 91. A battery 99 may be detachably installed in a lower side space of the grip main body 91. The battery 99 may be charged by receiving power from the first electrical terminal 95 and the second electrical terminal 96.

Figure 13:
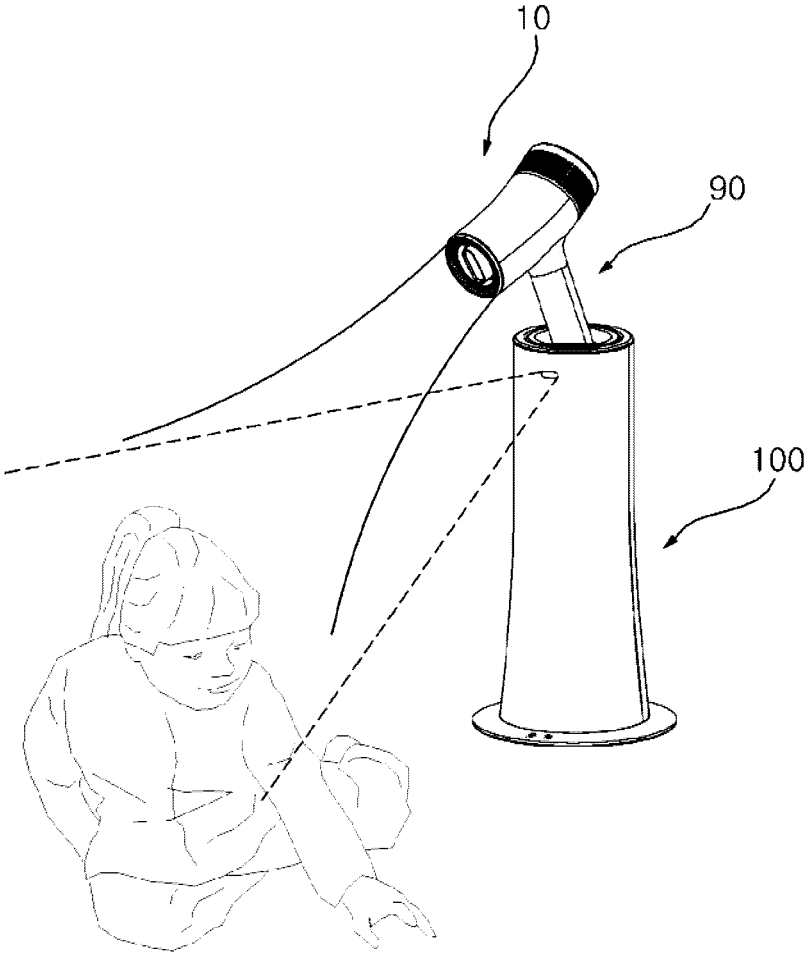
FIG. 13 is a perspective view of a dryer installed in a stand according to an embodiment of the present disclosure.

Referring to FIG. 13, the grip 90 is held in a stand 100, and therefore, the dryer can be driven even in a state in which a user is not gripping the dryer. The dryer may be adjusted in height and angle suitable for a size of a drying target object and then discharge drying air.

According to the dryer of the present disclosure, there are one or more effects as below.

First, the dryer according to an embodiment of the present disclosure is formed such that the rotation shaft 41 of the motor 40 and the discharge tube 30 are connected to each other via a connector 44 so that the discharge tube 30 for discharging drying air to the outside can be rotated on an axial line forming a predetermined angle relative to the rotation axis while rotated in the rotation direction of the rotation shaft 41 of the motor 40, and therefore, a mechanism may be realized such that the direction can be changed while the discharge tube 30 is rotated.

Second, the present disclosure is configured such that the link block 43 having the through hole formed therein is fixed to one end of the rotation shaft 41, and the connector 44 passes through the through hole so as to be orthogonal to the rotation shaft 41, so that the discharge tube 30 can be connected to both ends 441 of the connector 44 to be rotatable about an axial line of the connector 44, and thereby an efficient mechanism for biaxial rotation of the discharge tube 30 can be realized.

Third, the present disclosure is configured such that at least a part of the motor 40 for generating power to rotate the discharge tube 30 is inserted into the motor engaging part 42*a* of the motor mount 42 so that the motor 40 can be engaged with the motor engaging part 42*a*, and the bracket part 42*b* is formed to extend from an outer side of the motor engaging part 42*a* so that the bracket part 42*b* is affixed to the inner sleeve 50 disposed inside the casing 10, and thereby the motor 40 can be easily fixed at a predetermined location inside the casing 10.

Fourth, the dryer according to the present disclosure is configured such that a pair of protrusions 35 formed on the discharge tube 30 is rotated upon rotation of the discharge tube 30 while being guided along a closed-curve and a waveform-shaped groove 601 formed in the cylindrical guide 60, and both ends 441 of the connector 44, being connected orthogonally to the rotation shaft 41 of the motor 40, are inserted into a pair of recessed portions 37 or a pair of holes 360 formed in the discharge tube 30, and therefore, the discharge tube 30 can be rotated in the rotation direction of the rotation shaft 41 and at the same time rotated by a predetermined angle relative to the axial line of the connector 44 in forward and backward directions, and this causes the air outlet of the discharge tube 30 to continuously move from one side to the outer side and from the other side to one side. Accordingly, since a direction of drying air to be discharged from the air outlet keeps changing, the drying air discharged to a drying target body part can be widely dispersed, and thereby the target body part can be dried effectively.

It will be appreciated by persons skilled in the art that the effects that can be achieved with the present disclosure are not limited to what has been particularly described hereinabove and other effects not mentioned in the present disclosure will be more clearly understood from the following detailed description taken in conjunction with the accompanying drawings.

What is claimed is:

1. A dryer, comprising:

a hollow casing having a front opening;

a fan located within the casing to introduce air into the casing and produce a flow of air;

a heater located within the casing to heat the air introduced into the casing;

a discharge tube located within the casing, the discharge tube being rotatable within the casing, the discharge tube having an air inlet at a rear side of the discharge tube and an air outlet at a front side of the discharge tube;

a motor having a rotation shaft to rotate the discharge tube, the rotation shaft being rotatable about a first axis; and a connector connected to the rotation shaft, the connector being configured to enable the discharge tube to be rotated about the first axis and also to be rotated about a second axis oriented at a predetermined angle relative to the first axis, wherein the discharge tube comprises:

a pair of inwardly protruding blocks protruding inwardly toward one another; and a pair of recessed portions located in the pair of inwardly protruding blocks, and wherein a first end of the connector and a second end of the connector are located within the recessed portions to be rotatable with respect to the discharge tube.

2. The dryer of claim 1, further comprising a link block connected between the connector and the rotation shaft.

3. The dryer of claim 2, wherein the link block comprises an aperture into which the rotation shaft is inserted and fixed, and wherein the connector extends outwardly from the link block.

4. The dryer of claim 3, wherein the first end of the connector extends outwardly from the link block in a first direction, wherein the second end of the connector extends outwardly from the link block in a second direction opposed to the first direction, and wherein the first end and the second end are connected to the discharge tube.

5. The dryer of claim 4, wherein the discharge tube comprises a pair of holes opposing each other, and wherein the first end of the connector and the second end of the connector are located within the holes to be rotatable with respect to the discharge tube.

6. The dryer of claim 1, further comprising a pair of stoppers to cover at least part of the recessed portions, wherein the stoppers are connected to the inwardly protruding blocks.

7. The dryer of claim 1, further comprising:

a cylindrical inner sleeve located within the casing; and a motor mount fixed to the inner sleeve, wherein the motor is mounted to the motor mount.

8. The dryer of claim 7, wherein the motor mount comprises:

a motor engaging part onto which at least a part of the motor is engaged, the motor engaging part including a hollow portion through which the rotation shaft of the motor passes; and a bracket part connected to the motor engaging part, the bracket part being fixed to the inner sleeve.

9. The dryer of claim 1, wherein the air outlet at the front side of the discharge tube rotates as the discharge tube is rotated about the first axis, and wherein a center point of the air outlet moves laterally of the first axis as the discharge tube is rotated about the second axis.

10. The dryer of claim 1, wherein a size of the air outlet of the discharge tube is smaller than a size of the air inlet of the discharge tube.

11. A dryer, comprising:

a hollow casing having a front opening;

a fan located within the casing to introduce air into the casing and produce a flow of air;

a heater located within the casing to heat the air introduced into the casing;

a discharge tube located within the casing, the discharge tube being rotatable within the casing, the discharge tube having an air inlet at a rear side of the discharge tube and an air outlet at a front side of the discharge tube;

a motor having a rotation shaft to rotate the discharge tube, the rotation shaft being rotatable about a first axis; and a connector connected to the rotation shaft, the connector being configured to enable the discharge tube to be rotated about the first axis and also to be rotated about a second axis oriented at a predetermined angle relative to the first axis, wherein the discharge tube comprises a protrusion extending in a radially outward direction of the discharge tube, wherein the casing comprises a groove formed inside the casing, and wherein the protrusion is movable along the groove.

12. The dryer of claim 11, wherein the casing comprises a cylindrical guide, and wherein the groove is formed in the cylindrical guide.

13. The dryer of claim 12, wherein the cylindrical guide comprises a plurality of guide pieces coupled together.

14. The dryer of claim 12, wherein the groove forms a closed curve so that the protrusion is continuously movable along the groove when the discharge tube is rotated.

15. The dryer of claim 14, wherein a shape of the groove is a sine wave.

16. The dryer of claim 14, wherein the protrusion comprises a pair of protrusions that are spaced apart from each other by 180 degrees in a rotation direction of the discharge tube.

17. The dryer of claim 16, wherein a virtual straight line connecting the pair of protrusions is orthogonal to a central axis of the connector.

* * * * *